US007810896B2

(12) United States Patent
Mizes et al.

(10) Patent No.: US 7,810,896 B2
(45) Date of Patent: Oct. 12, 2010

(54) SYSTEMS AND METHODS FOR MONITORING JETS WITH FULL WIDTH ARRAY LINEAR SENSORS

(75) Inventors: Howard Mizes, Pittsford, NY (US); R. Enrique Viturro, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 224 days.

(21) Appl. No.: 12/177,532

(22) Filed: Jul. 22, 2008

(65) Prior Publication Data

US 2010/0020121 A1 Jan. 28, 2010

(51) Int. Cl.
*B41J 29/393* (2006.01)

(52) U.S. Cl. ..... 347/19; 347/15

(58) Field of Classification Search ..... 347/12, 347/14, 15, 19; 358/504
See application file for complete search history.

(56) References Cited

U.S. PATENT DOCUMENTS

| | | | | |
|---|---|---|---|---|
| 5,767,876 | A * | 6/1998 | Koike et al. | 347/43 |
| 6,354,689 | B1 * | 3/2002 | Couwenhoven et al. | 347/19 |
| 6,739,699 | B1 * | 5/2004 | Sender et al. | 347/43 |
| 7,377,613 | B2 * | 5/2008 | Yamazaki et al. | 347/19 |

* cited by examiner

*Primary Examiner*—Lamson D Nguyen
(74) *Attorney, Agent, or Firm*—Oliff & Berridge, PLC

(57) ABSTRACT

Systems and methods are provided for monitoring jets of an image device. The detection is implemented using a data processor that monitors information sent to a jet and using an image sensor that monitors an image being printed or an image after being printed. A detector detects the difference between the image being printed and/or the image after printing to the information sent to the jet, and identifies a faulty jet based on the difference detected.

21 Claims, 8 Drawing Sheets
(1 of 8 Drawing Sheet(s) Filed in Color)

SYSTEMS AND METHODS FOR MONITORING JETS WITH FULL WIDTH ARRAY LINEAR SENSORS

BACKGROUND

Production of quality images require a plurality of jets of an imaging device to fire with adequate ink drop size, with adequate strength, and without omission. Monitoring the performance of such devices is desirable.

SUMMARY

Some imaging devices, such as continuous feed printers, require continuous operation of print heads over an extended period of time. Each of the print heads of the continuous feed printer may have a plurality of jets, each firing drops of ink during operation. When producing work product on such devices, it is necessary that the plurality of jets work continuously, with adequate strength and without omission. Malfunctioning jets can cause great delay at great cost to customers.

Detecting problematic jets in the related art requires extraneous printing of test images and requires additional time and cost beyond the malfunction delay for detecting and remedying problematic jets. More efficient detection of problematic jets is required as the need for larger and faster imaging jobs increases.

Although a printer is discussed herein as an exemplary embodiment of the systems and methods for monitoring jets with full width array linear sensors, the features described below may also be adopted for use in any other relevant device including but not limited to copiers, facsimile machines, etc.

Techniques are disclosed that enable a printing device to monitor the performance of print head jets. A normally functioning print head jet fires drops of ink that produce pixels of appropriate density on the print medium. Each print job represents a plurality of drops of ink fired by a plurality of jets on a print head. The coordination of the jets firing the drops of ink produces a desired image on a print medium. However, print head jets are subject to periodic failure. In one instance, a print head jet may fire drops of insufficient drop size, resulting in a print density that may be less than a neighboring density from a sufficient drop size. Consequently, a streak may occur in the image.

In a second instance, a print head jet may not consistently fire drops. The missing drops of ink will lead to lesser print density in the pixel columns written by the jet, thus also producing a streak. In yet another instance, a print head jet may lose its ability to fire drops of ink. As a result, there will be no ink written in the pixel column intended to be written by that jet and thus a streak is produced. When a defect in a print head jet occurs, it is desirable that such defect be quickly detected.

For example, U.S. Patent Publication No. 2006/0114284, incorporated herein by reference, describes a system for detecting intermittent, weak and missing jets by printing a short pattern of dashes in between customer images at locations where the sheets will be cut. If a dash is missing from the test pattern, it is flagged as a missing jet. The process of cutting sheets from the roll of paper may remove these inter-document zone test patterns. However, under some situations, the amount of space and the amount of paper required to print this test pattern may be objectionable to the customer. Furthermore, most printers use single cutter equipment that may be unable to cut off the test pattern print areas. While it may be possible to purge the heads between each job for short print jobs, it may not be desirable to stop the job and recover missing jets of a continuous feed printer. Therefore, it is desirable to develop a technique to enable the detection of missing jets without having to cut out the test patterns. Systems and methods are provided for monitoring the plurality of jets of a printer with a full width array linear sensor.

In various embodiments of systems and methods for monitoring jets on a printer, information corresponding to an image being sent to a jet for printing may be monitored. The image being printed or the image after printing may also be monitored. A difference between the image being printed or the image after printing to the information sent to the jet may be detected, and the jet, based on the difference detected and a predefined condition, may be identified and displayed.

These and other features are described in, or are apparent from the following detailed description.

BRIEF DESCRIPTION OF THE DRAWINGS

This patent application file contains at least one drawing executed in color. Various exemplary details are described, with reference to the following figures, wherein.

EMBODIMENTS

Figure 1A:
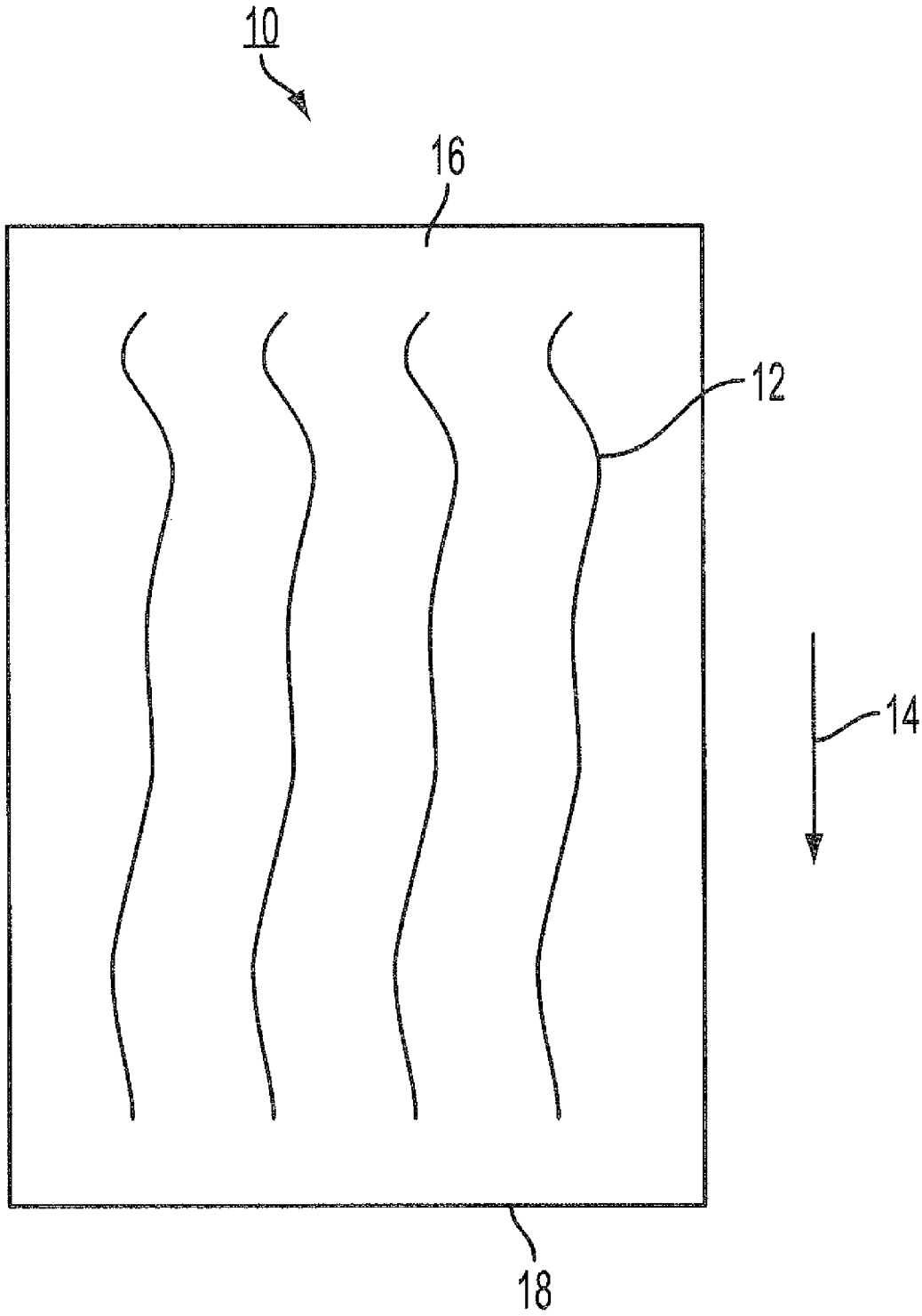
FIGS. 1A and 1B illustrate an image representing information sent to the jet and an image being printed or the image after printing in an exemplary embodiment.

FIG. 1A shows information corresponding to an image being sent to a jet for printing. This information represents an exemplary image 10. The exemplary image 10 may include text and/or graphics 12. The exemplary image 10 may be in black and white or in color. The exemplary image 10 represents what a user intends to print. The printing of an exemplary image 10 runs in a vertical direction 14. The image is printed first at or near lead edge 16 of a media. The printing of the exemplary image 10 continues until the tail edge 18 of the media is reached.

Figure 1B:
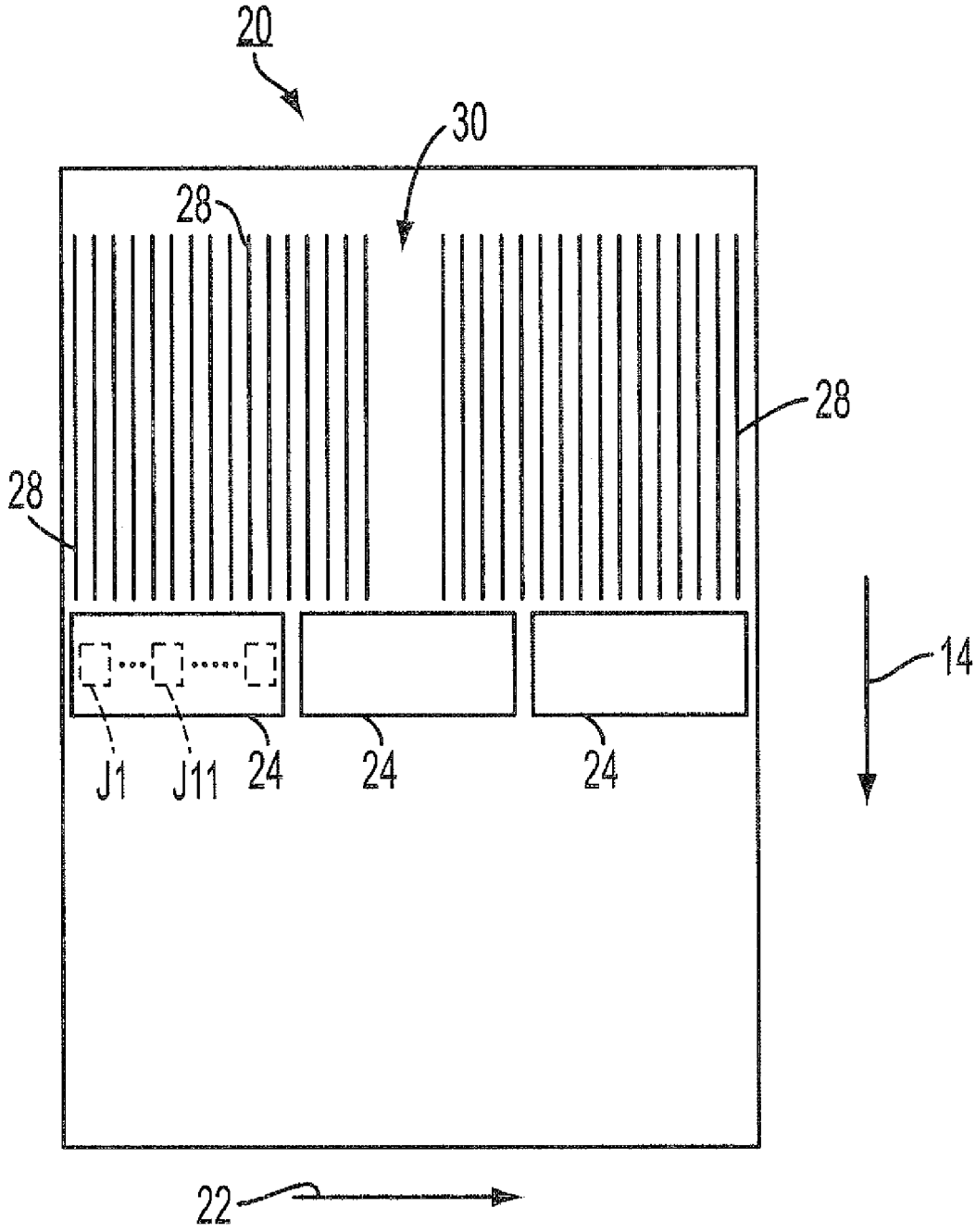

In one embodiment, the exemplary image 10 on the media represents a continuous feed document. FIG. 1B shows the image being printed or the image after printing 20. As shown in FIG. 1B, the image being printed or the image after printing 20 may be printed by the print heads 24 in a single pass. Each print head may print a section of the image 28. The media continuously moves in the process direction 14, and an image 28 is built by each print head. As shown in FIG. 1B, for example, an image 28 may be printed with a failed jet among the plurality of print heads 24. In particular, the printed image 28 may be printed primarily with normal jets, while a portion 30 of the image 28 is printed with a failed jet.

The failure of one or more of the plurality of print heads 24 may include, for example, droplets of ink with a smaller mass than the rest of the jets on the print head 24. Other failures may include, for example, jets that fire with inadequate strength or inaccurate aim. Thus, as shown in FIG. 1B, although most of the printed image 28 is printed uniformly, the ink coverage may not be as dense in certain areas, for example, portion 30, because of the failure of one or more of the print heads 24. A failed jet, for example, may produce an undesirable streak in the printing. Thus, it is desirable to detect such a defect to correct or otherwise address the defect.

Figure 2:
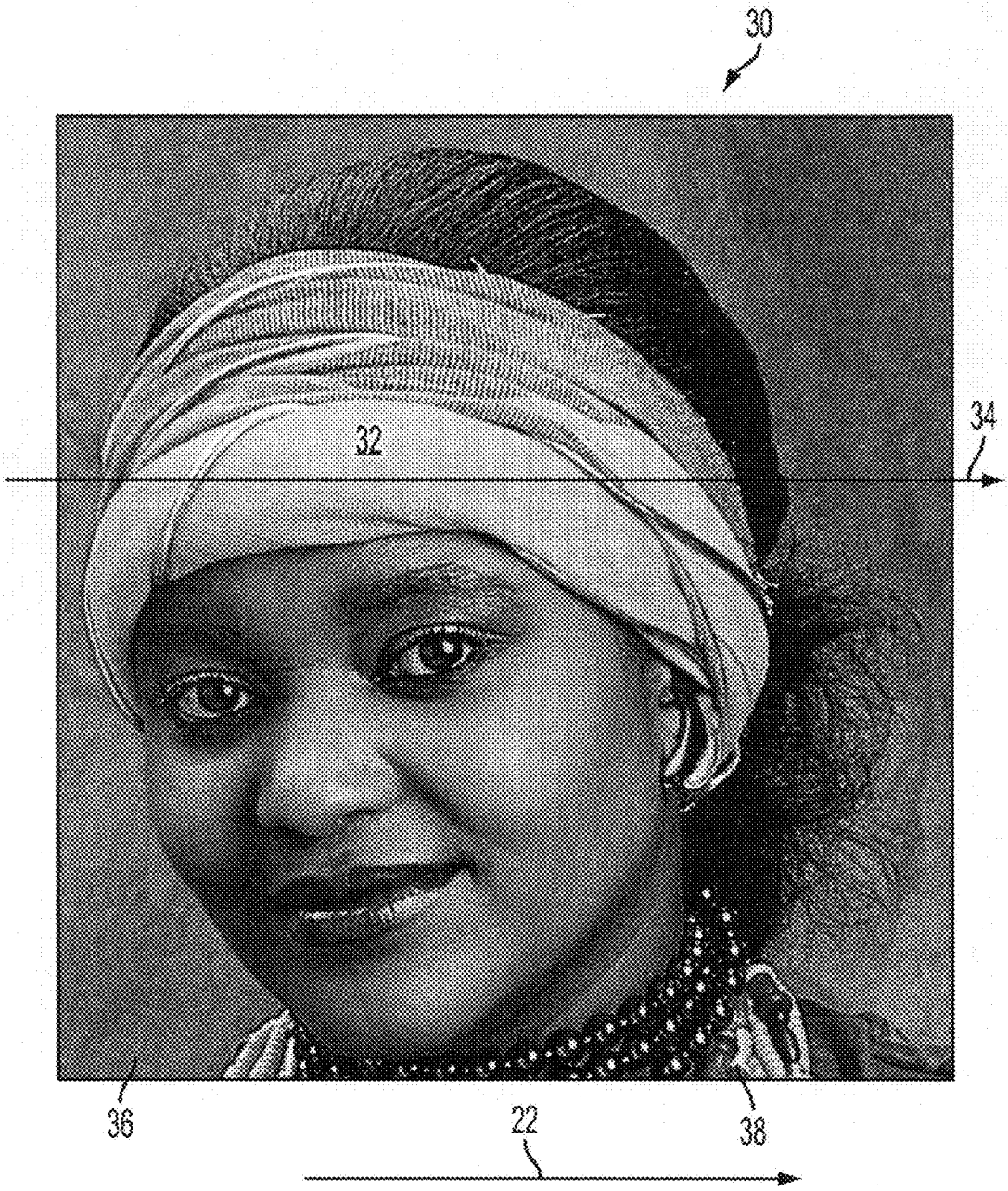
FIG. 2 illustrates an example of a customer image in an exemplary embodiment.
Figure 5:
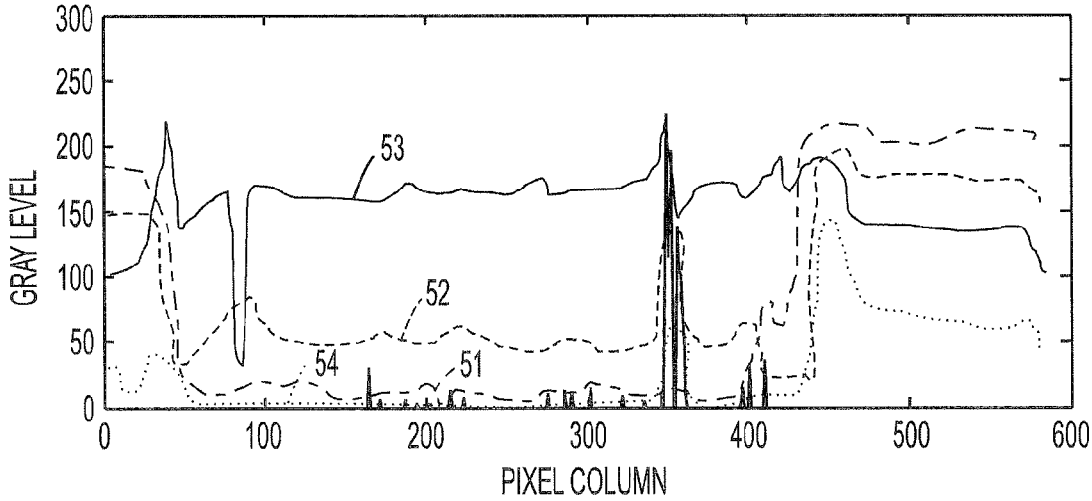
FIG. 5 shows the profile of the gray level ink area coverage at the scan line illustrated in FIG. 2.

FIG. 2 illustrates an example of a customer image 30. The headband 32 in the customer image 30 is dominated by the color yellow. A single scan line 34 of the customer image may be examined (see also FIG. 5). It may be difficult for a full width array sensor to distinguish the individual densities of different ink colors, if two or more inks are jetting on the same area of the page. This can occur if the full width array is a monochrome sensor. Under these conditions, it is desirable to examine only pixels dominated by a single primary color. In one embodiment of this invention, a pixel is dominated by a single primary color if the gray level of one primary color is much greater than the gray level of the other primary colors. When this condition is met, this pixel is defined as a monitorable pixel. Between approximately pixel 100 and pixel 400 of FIG. 5, gray levels of the yellow pixels are significantly greater than the sum of the gray levels of the other color separations, as shown in FIG. 5. Pixels 100 and 400 are depicted as points 36 and 38, respectively, in FIG. 2. The pixels for which the gray level of the yellow pixels are significantly greater than the sum of the gray levels of the other color separations may be tagged as monitorable pixels. Monitorable pixels may be those pixels where a full width array linear sensor may detect differences in reflectances from the information of the exemplary image. An accumulation buffer is created to track the number of monitorable pixels in each pixel column. For each pixel column, when a monitorable pixel occurs, the accumulation buffer for that pixel column is incremented by one. Accordingly, the yellow valid digital accumulation buffer between pixel 100 and 400 is incremented by one.

The scan line 34 of the customer image 30 may be sensed by, for example, a full width array linear sensor. When a digital image is accumulated, each color plane may be accumulated separately since the color may be known. However, the ink color of the sensed image may not be known for all conditions. For example, a monochrome sensor with white light illumination may have a low contrast to yellow ink and a large contrast for black ink. The accumulation of the sensor response to a low coverage of black may be equivalent to the accumulation of the sensor response to a high coverage of yellow.

In one embodiment, the sensor is a monochrome full width array linear sensor. The monochrome sensor may be used to perform a pixel column accumulation when a contribution from a single color channel may be greater than a threshold, for example 80-90%. The contribution of the other color separations may then contribute less than 20-10%. This contribution may be just noise. The threshold of the monochrome sensor may be chosen so the noise contribution from other channels may not be enough to prevent the technique from being applied.

In an alternate embodiment, the sensor is a Red/Green/Blue (RGB) full width array linear sensor. The RGB sensor may detect variations in color separations with more precision than a monochrome sensor. The RGB sensor may further track the variation values and may associate the changes to a particular color ink. For areas where there are 3 or less different inks being imaged over the same area, it may be possible to develop a calibration function which maps the response of each color channel to the area coverage of each of the 3 or less inks.

Although a monochrome full width array linear sensor and an RGB full width array linear sensor are discussed herein as exemplary embodiments, any sensor that can detect a spectrum on a gray scale or color scale may be used.

The sensors may detect a single scan line consisting of a profile of the area coverage of a plurality of colors as a function of pixels in a cross process direction. A total number of jets printed from every jet from every head over a recent part of the job may be accumulated. The accumulation may result in a vector that is $N_{jets} \times N_{heads}$ long, wherein $N_{jets}$ is the number of jets per head and $N_{heads}$ is the number of heads in a printer.

For certain customer images, there may be few areas of the image which consists of more than 80-90% area coverage of one of the color separations required for the monochrome sensor. It would therefore take a larger number of images to build up the statistics to detect a missing jet. However, if a missing jet does occur in an image, it may appear in a region of the image that may consist of more than one color since the presence of a second color may mask the severity of the missing jet. Thus, when there may be less data in the customer image to identify a missing jet, it may be less likely the missing jet will be observed.

Consequently, a rolling average from each pixel of the full width array linear sensor may be accumulated over the same length of image in the process direction 14 that corresponds to the digital image. The linear array response may be subtracted from the bare paper response so that the contribution from blank areas from the image may be zero. For areas that have an image, some number may be greater than zero.

The linear array response can be mapped from the linear array space to the digital image space by using the information of the x alignment fiducials that can be printed at the beginning of each job. For example, if jet J1 of the left most print head is captured by linear array pixel 436 at the beginning of the job and jet J11 of the left most print head is captured by linear array pixel 456 at the beginning of the job, then a linear transform is applied that maps linear array pixel columns 436 through 456 to digital image positions that print from between jets J1 and J11.

In various exemplary embodiments, the linear array sensor may be operated in diffuse mode or specular mode. In diffuse mode, the detectors may be oriented normal to the surface being imaged, and the illuminators may be at some angle. The contrast may arise from the difference in geometry between the ink and the substrate. The contrast also may arise due to a difference between the reflectance of the substrate and the reflectance of the ink. In specular mode, the contrast may arise because of the difference in the amount of light scattered when imaging the substrate and when imaging ink on the substrate.

Figure 3A:
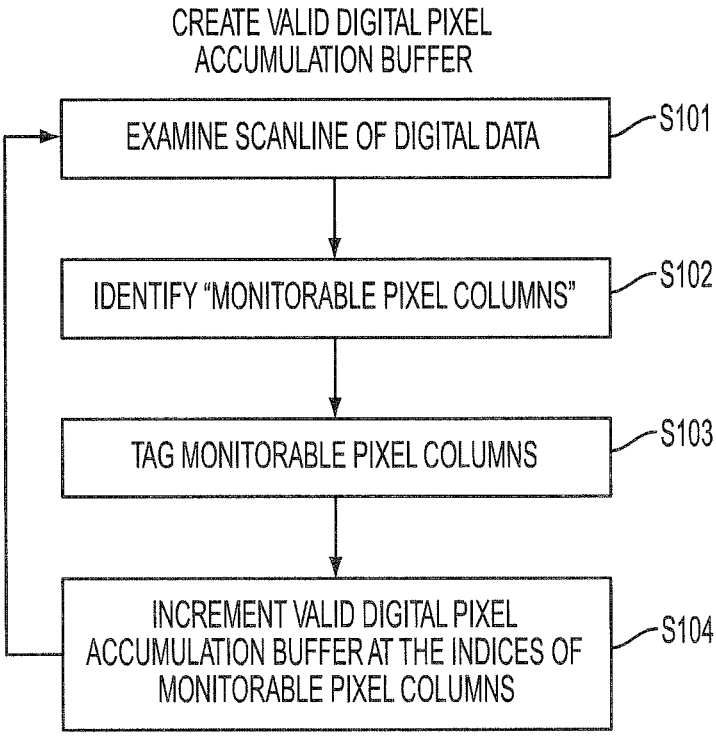
FIGS. 3A, 3B and 3C depict flow charts outlining embodiments of a method for monitoring jets of a printer in an exemplary embodiment.

FIG. 3A illustrates a flow chart of a technique to identify a pixel with contribution from a single color channel that is greater than some threshold contribution. As shown at S101, a single scan line of a digital data may be examined. An example of a single scan line 34 of a customer image 30 is depicted in FIG. 2. The single scan line 34 may include a profile of the area coverage of cyan ink, magenta ink, yellow ink, and black ink as a function of pixels in the cross process direction 22. Pixels for which gray levels of the color pixels may be significantly greater than the sum of the gray level of the other color separations may be identified as shown at S102. These pixels may subsequently be tagged as monitorable pixels as shown at S103. For each tagged pixel, a valid digital pixel accumulation buffer may be incremented at the indices of monitorable pixel columns, as shown at S104.

Figure 3B:
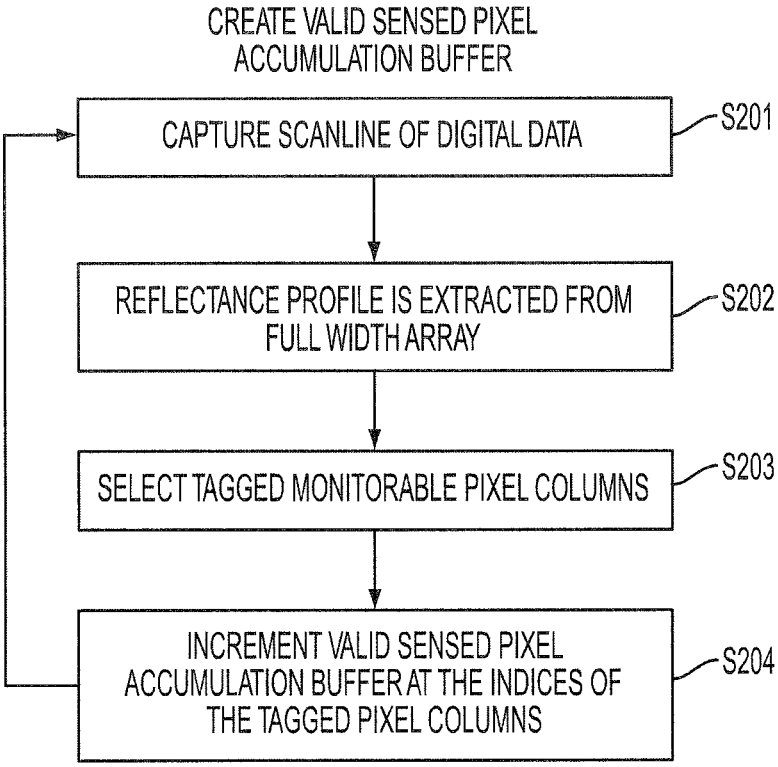

FIG. 3B illustrates a flow chart of a technique to identify pixels with contributions from a single color channel that may be greater than some threshold contribution. The image in FIG. 2 may be captured, for example, by a full width array. The digital data may be allocated among the print heads in the print path and may be reconsolidated as the print medium passes under each print head. The completed image then may pass under the full width array sensor and an image may be captured as shown at S201.

The delay between the sending of this digital signal and the capture of the image may be known. The delay may be adjusted in S201 to ensure that the scan line of the image data collected by the full width array corresponds to the previously tagged image data. The full width array sensor extracts a reflectance profile from the collected image as shown at S202. For each color ink, the reflectance profile is a profile of the mass of ink on the media times a factor that depends on the amount of light absorbed by the ink. The profile measured by the full width array is the sum of the reflectance profile for each color ink. Sections of the reflectance profile corresponding to the tagged pixels, as shown at S103, are then selected at S203. The valid sensed pixel accumulation buffer at the indices of the tagged pixel columns may then be incremented as show at S204. For example, reflectances may accumulate corresponding to a yellow gray level of 150 between pixel columns 100 and 400 from the customer image of FIG. 2 each time the scan line 34 of the image passes under the full width array for a properly functioning printer.

Figure 3C:
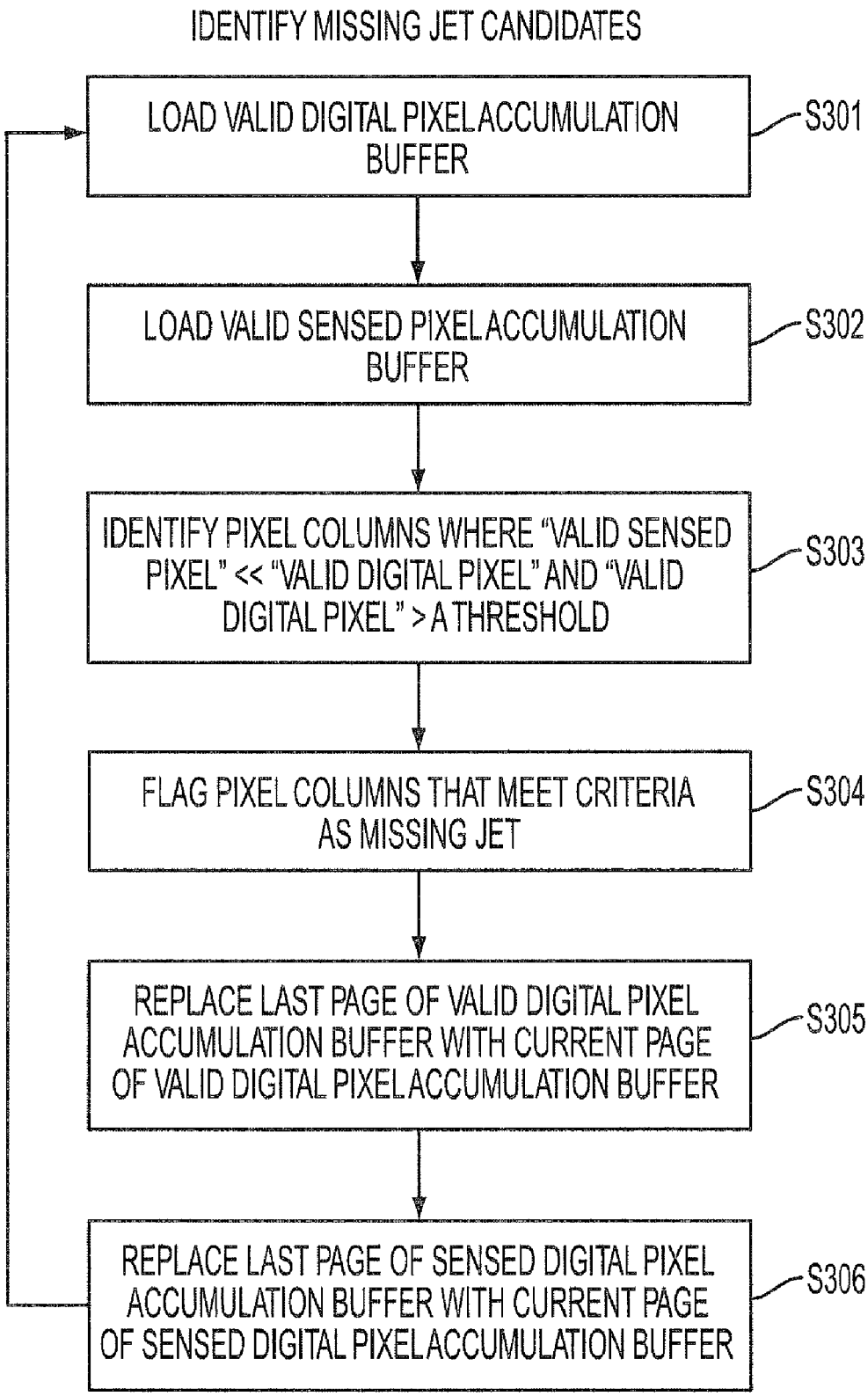

FIG. 3C illustrates how abnormally performing print head jets may be identified from the accumulated pixel buffers. As shown at S301, the valid digital pixel accumulation buffer may be loaded for comparison. As shown at S302, the valid sensed pixel accumulation buffer may be loaded for comparison to the valid digital pixel. The two accumulation buffers may be compared, at a location on the image being printed or the image after printing, pixel by pixel for each color separation at S303 and should meet two criteria discussed below. If the valid digital pixel buffer value exceeds a user determined threshold, then enough digital pixels have been printed to determine if a jet may be printing correctly. However, if the valid sensed pixel buffer value at that location is much less than the valid digital pixel buffer value at that location, then the pixel column and color separation may be flagged as an abnormally performing jet as shown at S304.

Older or the oldest sensed data in the digital pixel buffers may be subtracted out of the buffers in order to dynamically detect abnormally performing jets as they occur. After a defined number of pages have been printed and sensed, the last page worth of data in the valid digital pixel accumulation buffer may be replaced with the current page of valid digital pixel accumulation data, as shown at S305. The same replacement may be done for the sensed digital pixel accumulation buffer as shown at S306.

Figure 4:
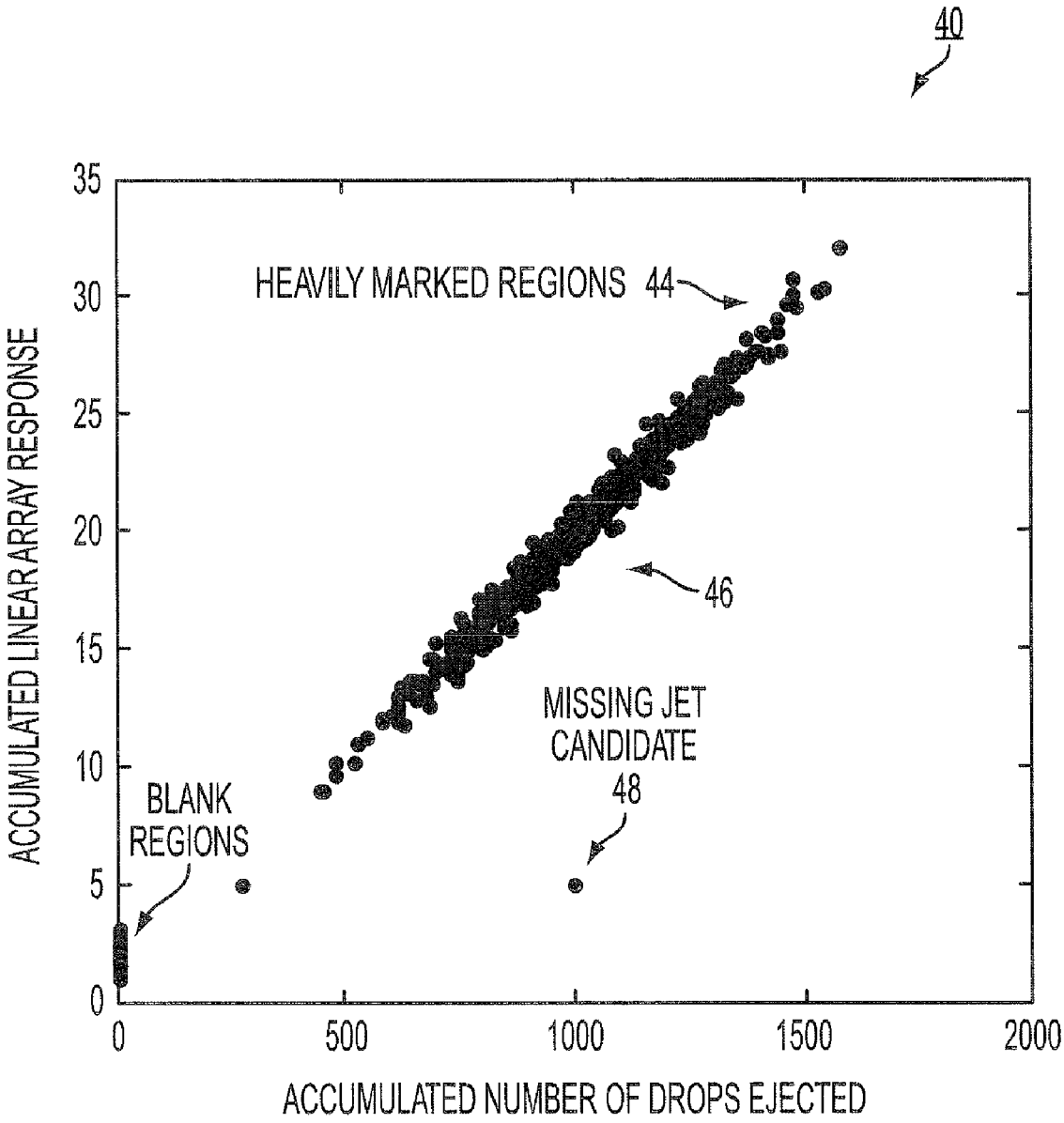
FIG. 4 illustrates an isoplot depicting accumulation as a function of pixel column in an exemplary embodiment.

FIG. 4 shows an isoplot 40 of the sum of the sensed image pixels. At various intervals, an isoplot of the sum of the digital image pixels may be compared to an isoplot of the sum of the sensed image pixels. Any discrepancies from the isoplot associated with the digital image pixels and the sensed image pixels may indicate a failed print head jet.

In the isoplot, there may be a large number of points near zero. These points near zero correspond to blank areas of the page where regions of the customer image may not meet the accumulation criteria. There may also be points near zero, which correspond to regions of the image that do not print sufficiently during the set of pages that were accumulated. Such regions may be characterized as lacking in ink coverage. The sensed image from these regions may have similar characteristics as the sensed image of the print medium where there is no ink coverage. Points in an isoplot that are far from zero 44 correspond to jets that may have been printing sufficiently during the accumulation of the image. Such regions may be characterized as having significant ink coverage. The sensed image from these regions may have similar characteristics as the sensed image of other regions where there is significant ink coverage but not necessarily of the same color.

All the points may lie along a straight line 46 with a slope that corresponds to the sensitivity of the sensed image to the number of pixels. Lesser deviations from the straight line may be due to noise in the measurement. Points that deviate further from the straight line 46 may be candidates for abnormally functioning jets. A running average of the isoplot 40 should be monitored, and the number of pages used to accumulate the isoplot 40 may be chosen to detect the missing jets as rapid as possible at the expense of increased noise.

FIG. 5 shows a profile of the ink area covered at the scan line 34 illustrated in FIG. 2. The line 51 plots the gray level of cyan ink as a function of position along scan line 34. The line 52 plots the gray level of magenta ink as a function of position along scan line 34. The line 53 plots the gray level of yellow ink as a function of position along scan line 34. The line 54 plots the gray level of black ink as a function of position along scan line 34. Between approximately pixels 100 and 400 in FIG. 5, the gray level of the yellow ink is significantly greater than the sum of the gray levels of the other color separations. The pixels for which this criteria are met may be tagged as monitorable pixels.

Figure 6:
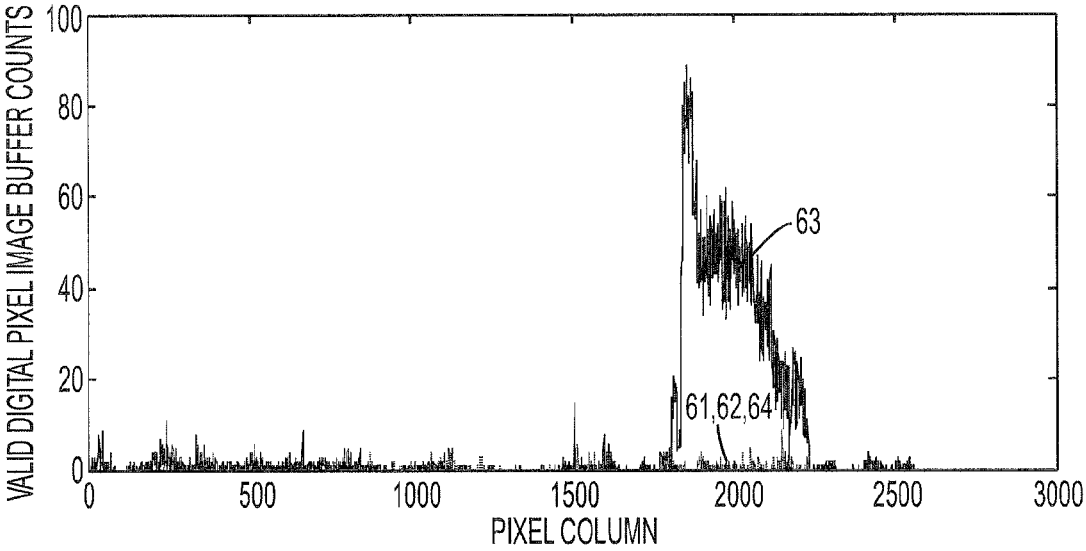
FIG. 6 illustrates the counts of valid digital pixel accumulation buffered for the complete image of FIG. 2.

FIG. 6 plots the count of the valid digital pixel accumulation buffer for the complete image of which FIG. 2 in one section. Line 61 corresponds to the integrated number of monitorable cyan pixels as a function of full width array pixel column. Line 62 corresponds to the integrated number of monitorable magenta pixels as a function of full width array pixel column. Line 64 corresponds to the integrated number of monitorable black pixels as a function of full width array pixel column. Line 61, 62, and 64 are near the x-axis, indicating few monitorable cyan, magenta, and black monitorable jets. Line 63 corresponds to the integrated number of monitorable yellow pixels as a function of full width array pixel column. The value of this line is large compared to the others, because the yellow valid digital pixel accumulation buffer may be incremented between 40 to 50 pixels each time the image is between pixel columns 1800 to 2300. This section of the image may provide an opportunity to detect an abnormally performing jet.

Figure 7:
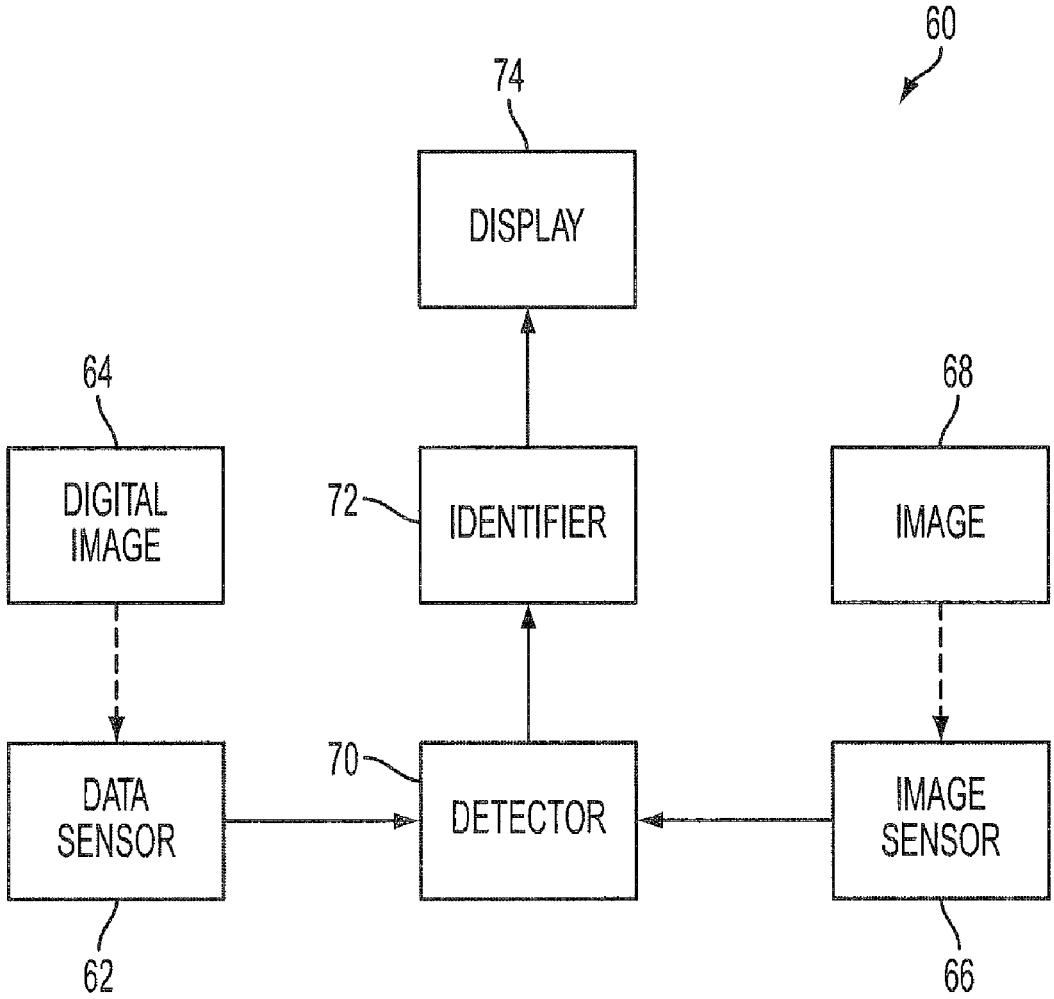
FIG. 7 illustrates a block diagram of the system for monitoring jets of a printer in an exemplary embodiment.

FIG. 7 depicts a block diagram of a system 60 for monitoring jets of a printer. A data sensor 62 monitors the information sent to a jet. The information sent to the jet may be an exemplary digital image 64. The exemplary image 10 may be in black and white or in color. An image sensor 66 monitors the image 68 being printed or after being printed. The image sensor 66 may be a monochrome full width array linear sensor or a RGB full width array linear sensor. A detector 70 detects a difference between the image being printed or the image after printing to the information sent to the jet. For monochrome sensors, the detector 70 may perform a pixel column accumulation when a contribution from a single color channel may be greater than a threshold, for example 80-90%. For RGB sensors, the detector 70 detects variations in color separations with more precision than a monochrome sensor. An identifier 72 identifies the jet based on the difference detected and then displays the identified jet on a display 74.

In various exemplary embodiments, the system is implemented on a programmable general-purpose computer. However, the system can also be implemented on a special purpose computer, a program microprocessor or microcontroller and peripheral integrated circuit elements. In general, any device capable of implementing a finite state machine that is in turn capable of implementing the flow chart shown in FIG. 3A-3C can be used to implement the system 60.

While various details have been described, these details should be viewed as illustrative, and not limiting. Various modifications, substitutes, improvements or the like may be implemented within the spirit and scope of the forgoing disclosure.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for monitoring jets of an imaging device that outputs an image based on image information sent to the jets, the method comprising:

monitoring the image information sent to the jets;

monitoring at least a portion of the output image;

detecting a difference between the portion of the output image and the image information sent to the jets; and identifying a faulty jet based on the difference detected.

2. The method of claim 1, the identifying the faulty jet based on the difference detected further includes comparing the difference detected with a predetermined condition.

3. The method of claim 1, further comprising notifying a user of the identified faulty jet.

4. The method of claim 1, wherein the monitoring at least a portion of the output image includes performing a pixel column accumulation under the condition that a contribution from a single color is greater than a threshold.

5. The method of claim 4, wherein the threshold is determined by a user.

6. The method of claim 1, wherein the monitoring the at least a portion of the output image further includes:

detecting a plurality of values of variation in color separations, tracking the plurality of values of variation, and associating a change in at least two of the plurality of values of variation to a particular color ink.

7. The method of claim 1, the monitoring the image information sent to the jets and the monitoring at least a portion of the output image being conducted at predetermined intervals.

8. The method of claim 1, wherein the monitoring the at least a portion of the output image includes examining a single scan line of digital data, the single scan line consisting of a profile of the area coverage of a plurality of colors as a function of pixels in a cross process direction.

9. The method of claim 1, the imaging device being a printer having printheads, the printheads each having a plurality of the jets, wherein monitoring at least a portion of the output image includes accumulating a total number of drops ejected from each jet used from each printhead, the accumulation resulting in a vector that is $N_{jets} \times N_{heads}$ long, where $N_{jets}$ is the number of jets per printhead and $N_{heads}$ is the number of printheads in the printer.

10. The method of claim 1, wherein the monitoring at least a portion of the output image includes identifying a color to monitor from the relative contribution of each color separation.

11. An imaging system for monitoring jets of an imaging device that outputs an image based on image information sent to the jets, the system comprising:

a data monitor that monitors the image information sent to the jets;

an image sensor that monitors at least a portion of the output image;

a detector that detects a difference between the portion of the output image and the information sent to the jets; and an identifier that identifies a faulty jet based on the difference detected.

12. The imaging system of claim 11, the identifier comparing the difference detected with a predetermined condition.

13. The imaging system of claim 11, further comprising a notification unit, which notifies a user of the identified faulty jet.

14. The imaging system of claim 11, wherein the image sensor performs a pixel column accumulation under the condition that a contribution from a single color is greater than a threshold.

15. The imaging system of claim 14, the threshold being determined by a user.

16. The imaging system of claim 11, wherein the image sensor detects a plurality of values of variation in color separations, tracks the plurality of values of variation and associates a change in at least two of the plurality of values of variation to a particular color ink.

17. The imaging system of claim 11, wherein the data monitor and image sensor function at predetermined intervals.

18. The imaging system of claim 11, wherein the image sensor examines a single scan line of digital data, the single scan line consisting of a profile of the area coverage of a plurality of colors as a function of pixels in a cross process direction.

19. The imaging system of claim 11, the imaging device being a printer having printheads, the printheads each having a plurality of the jets, wherein the data monitor monitors at least a portion of the output image including accumulating a total number of drops ejected from each jet used from each printhead, the accumulation resulting in a vector that is $N_{jets} \times N_{heads}$ long, where $N_{jets}$ is the number of jets per printhead and $N_{heads}$ is the number of printheads in the printer.

20. The imaging system of claim 11, wherein the image sensor uses information from the previously identified contribution of each color separation to monitor the reflectance of an individual color.

21. A xerographic device comprising:

means for monitoring image information sent to a jet;

means for monitoring at least a portion of an output image;

means for detecting a difference between the portion of the output image and the information sent to the jet; and means for identifying the jet based on the difference detected.

* * * * *